US005147258A

United States Patent [19]

Donohue

[11] Patent Number: 5,147,258

[45] Date of Patent: * Sep. 15, 1992

[54] PUNCHING BAG CONSTRUCTION AND SUSPENSION

[76] Inventor: Patrick T. Donohue, 1822 NE. 143rd, Portland, Oreg. 97230

[ * ] Notice: The portion of the term of this patent subsequent to Sep. 4, 2007 has been disclaimed.

[21] Appl. No.: 627,633

[22] Filed: Dec. 14, 1990

[51] Int. Cl.[5] ..... A63B 64/00

[52] U.S. Cl. ..... 482/87; 482/83; 482/86

[58] Field of Search ..... 273/584, 409, 67; 403/122; 272/78, 62; 446/77, 225

[56] References Cited

U.S. PATENT DOCUMENTS 600,777 3/1898 Frazier .
758,279 4/1904 Rhodes .
923,379 6/1909 Selfe .
1,119,635 12/1914 Reach .
1,356,817 10/1920 Gregory .
2,143,691 1/1939 Goldberg et al. .
2,323,624 7/1943 Schall .
2,510,883 6/1950 Goldberg .
2,548,089 4/1951 Wycosky .
2,625,770 1/1953 Steen et al. .
2,815,952 12/1957 Glasberg et al. .
2,935,321 5/1960 Lhotka .
3,226,116 12/1965 Klingler .
4,784,628 11/1988 Mcardle .
4,884,987 12/1989 Mason .
4,953,852 9/1990 Donohue .
4,957,299 9/1990 Richardson .

FOREIGN PATENT DOCUMENTS 4359 of 1886 United Kingdom .

*Primary Examiner*—Richard J. Apley
*Assistant Examiner*—J. Donnolly
*Attorney, Agent, or Firm*—Bruce J. Ffitch

[57] ABSTRACT

In a light duty punching bag and suspension arrangement the bag consists of one or two balloons. When two balloons are used one is inflated inside the other, the two uniting to form a resilient bag. The inflation neck of the bag is stretched over the skirt of an inflation collar which includes a valve for controlling inflation. A cap screwed on to the inflation collar provides a suspension connected and also clamps the bag wall to the skirt of the collar. Connection to an overhead rebound board is by a short flexible element and a ball and socket joint in tandem.

20 Claims, 1 Drawing Sheet

PUNCHING BAG CONSTRUCTION AND SUSPENSION

BACKGROUND OF THE INVENTION

This invention concerns exercise, recreational and training devices utilizing a suspended or tethered inflatable ball, and more particularly, a punching bag and its suspension.

There are many common desiderata in the performance characteristics and construction of suspended or tethered game or exercise balls or bags but, for simplicity, the following discussion will be limited to punching bags, sometimes called striking bags, and their suspension.

The general form of the conventional punching bag is well known. An approximately pear-shaped bag is suspended from a rebound board or platform fixed at such height above the floor that an erect "boxer" can comfortably sustain a steady regular series of strikes (a volley) on the bag. Bag and board are designed to produce, in combination, a desired coefficient of restitution or "bounce" of the bag from the board. For typical conventional and professional punching bags, this bounce corresponds to a rebound to strike ratio range of between 3 and 6 to 1.

In a typical conventional bag an inflatable bladder is contained in a relatively stiff and heavy leather casing. Consistency of rebound characteristic is achieved in part by suspending the bag from the board by a short flexible suspension the lower end of which is attached with substantial rigidity to the bag casing. That is, the attaching element at the bag is substantially fixed with respect to the bag itself. Between this bag attachment point and the rebound board the flexible connection usually provides at least two effective hinge points. The suspension is not a simple swivel, so that the bag swings simply radially with respect to the board, but rather a compound hinge which permits the bag to "rock" as well as swing when struck, and also to rock relative to the rebound board upon impacting the board.

At the suspension attachment point the bag may be reinforced by inserting a domed or conical collar into the neck of the bag and lacing or clamping the bag neck over it. The collar then provides a relatively inflexible attaching point for the bag. See for example U.S. Pat. Nos. 600,777 Frazier, 758,279 Rhodes, 1,119,635 Reach, and 2,815,952 Glasberg.

The flexible suspension may include combinations of elements such as a ball swivel and loops or rings of metal or leather or may comprise a short cord of rubber or other flexible material. See for example Reach and U.S. Pat. Nos. 2,323,624 Schall, 2,548,089 Wycosky and 3,226,116 Klingler.

Conventional and professional punching bags are relatively heavy and expensive. Because of the forces and shock loads developed, even in normal use, mounting arrangements must be "heavy duty" so that the installation is essentially permanent and not readily made portable. To avoid damage to the hands boxing gloves must be worn. For these and other reasons the market for the conventional suspended punching bag is well defined and quite limited.

Some attempts had been made to make punching bag action available to a wider public, including children. But in general these were more successful in visual simulation of the conventional punching bag than in a functional re-production of its desirable characteristics as outlined above. See for example the punching bag included in a free standing exercise kit offered by the toy retailer Toys R' Us TM. See also Klingler. A related disclosure is that of the Goldberg's in U.S. Pat. Nos. 2,143,691 and 2,510,883. These describe floor mounted rather than suspended "punching bags" and consist simply of an inflated balloon clipped to the upper end of a flexible standard. There is no serious attempt to make a stiff connection of the balloon to the standard or to reinforce the balloon wall.

In general the action provided by known scaled down light duty or toy versions of punching bags had been disappointing particularly in their failure to provide a satisfactory volley action. A typical defect was their use of a soft, inelastic casing, of vinyl for example. Such casings, in lighter or toy punching bags, produced poor bounce, were relatively expensive and comparatively heavy.

The punching bag and suspension of Donohue (U.S. Pat. No. 4,953,852) overcomes many of the problems of the prior art and offers a light duty punching bag with good functional characteristics. Its success is based largely on the "integration" of a resilient bag with a suspension collar. The bag consists of two similar elastic envelopes, one inside the other, and the suspension collar is inserted in an opening of the outer bag so that, upon inflation, a skirt of the collar is trapped between the walls of the two elastic envelopes. The inflation neck of the inner bag is accessible through an orifice in the collar and is closed or sealed after inflation, for example by a clip. Although its performance is good Donohue does require two elastic envelopes or balloons and the arrangement for sealing of the inner balloon may not be convenient or durable for repeated inflation and deflation of the punching bag.

SUMMARY OF THE INVENTION

Accordingly, it is an object of the invention to provide a simple, light duty exercise device or toy which even though lighter, approximates the rebound or volley action of a full sized or professional punching bag, and which is potentially low in manufacturing cost so as to be attractive to and affordable by a larger segment of the population.

It is a further object that a device according to the invention should be easily portable and adaptable to temporary mounting on a variety of vertical surfaces.

Another object of the invention is to provide a punching bag device which is operable with a punching bag comprising either two similar elastic envelopes such as two balloons, one within the other, or comprising a single elastic envelope or a single balloon of greater wall thickness.

Another object is to provide an inflation arrangement of improved convenience and durability.

Another object is to provide a punching bag arrangement with performance comparable to or improved over that disclosed in Donohue and with an alternative method of assembly or manufacture.

In preferred embodiments the punching bag may comprise one or two similar elastic bags. If two are used they include an inner inflatable one and a second encasing it so that inflation of the one distends the other. A stiff unitary neck and collar member having a skirt or flange and similar in shape to the upper portion of a bottle is positioned within the inflation neck of the inner bag so that the inflation necks or openings of the bags embrace the collar and at least the inflation neck of the inner bag is stretched sufficiently to form an airtight seal between the inflation neck and the collar. The neck of the collar member includes a valve so that the inner bag may be inflated and its inflation maintained. The bags are arranged so that, upon inflation, the inner bag distends the outer bag and their walls, in contact, form a unified resilient bag which, locally, bears down on at least the outer portion or rim of the skirt so that the collar member becomes resiliently united with the bag. The general arrangement of a punching bag using only a single elastic bag is similar, with the single bag corresponding essentially to the inner bag in the preceding description.

Preferably the collar member is capped by a cap of circular cross section which has a lower rim of a diameter at least approximately equal to the outside diameter of the skirt of the collar. In assembly and in operation the lower rim of the cap may bear down on the bag wall so that the wall is trapped or held against the skirt of the collar member near its outside diameter, thus enhancing the integrity and positional or rocking stability of the collar member relative to the bag. In the present invention, unlike Donohue, there is no bag *inside* the collar.

When the punching bag assembly is suspended the collar member becomes the anchoring point for the bag and preferably the cap provides the actual connecting point. The connecting linkage between rebound board and bag should permit not only simple "radial" swinging of the bag about the point of attachment to the board but also "rocking" of the bag relative to a radial from the point of suspension on the board. In its most elementary form the linkage has an effectively universal fixed pivot connection at one end in tandem with a hinge, preferably universal, completing the connection.

It is a feature of the invention that punching bags according to the invention may have performance characteristics such that satisfying volley activity can be maintained at a comfortable frequency even though the mass of the bag is much less than that of a conventional punching bag.

In preferred embodiments the bag may be constructed of one or a pair of conventional helium balloons of 6 or 7 inches nominal diameter. In one alternative form a single bag with a wall thickness greater than that of a conventional balloon may be used. The smoothness of surface of surface and lightness of such bags means that they can be used without boxing gloves.

It is another feature of the invention that the principal components susceptible to wear or damage, the bag and flexible suspension elements, may both be quickly and easily replaced at very low cost.

Other features and advantages of the invention will become apparent from the following description read in conjunction with the drawings.

DESCRIPTION OF THE PREFERRED EMBODIMENTS

Figure 1:
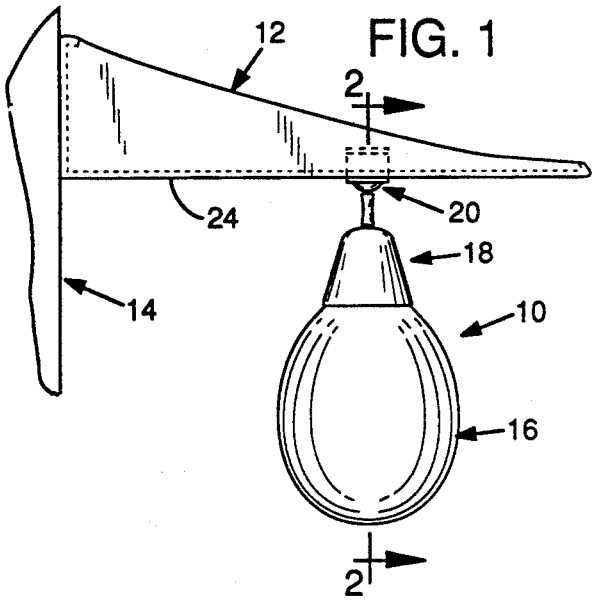
FIG. 1 is a side view showing a general arrangement of a punching bag installation embodying the invention.

A punching bag assembly 10 according to the invention is shown in general arrangement in FIG. 1. The punching bag assembly 10 is supported at an appropriate height above the ground by a rebound board or platform 12 attached by suitable means to an upright wall 14. The punching bag assembly 10 is made up of a bag 16 and its suspension 18. Variations of both are shown in the alternative embodiments of FIGS. 2 and 3.

Figure 2:
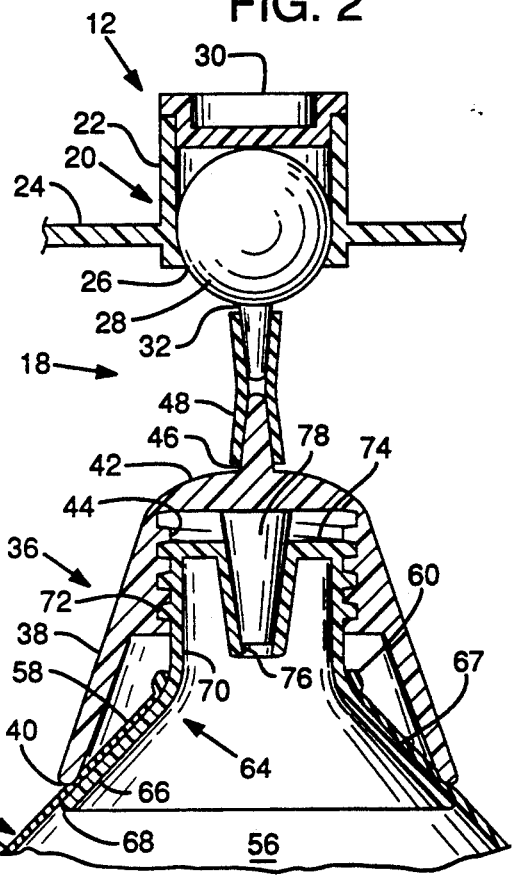
FIG. 2 is an enlarged cross-sectional partial view taken on line 2—2 of FIG. 1 showing details of the punching bag construction and its suspension.

Looking first at FIG. 2—the ultimate connection of the bag 16 to the rebound board 12 is by a universal swivel. In this embodiment it comprises a ball and socket assembly 20. The generally cylindrical socket 22 is molded integrally with the floor 24 of the rebound board 12. Its lower rim 26 conforms closely to the spherical surface of the ball 28 and a cap 30, pressed into the upper end of the socket 22, retains the ball 28 in the socket. Connection to the ball 28 is by way of a radially extending tapered pin 32 which is rigidly attached to the ball and may be molded integral with it. Both ball 28 (with pin 32) and rebound board 12 may be molded from a suitable plastic material.

The suspension is continued in a generally frusto-conical, screw-threaded suspension cap 36. In the cap 36 a frusto-conical side wall 38 terminates in a bottom or outer edge or rim 40 and is closed at its upper end by a slightly upwardly domed top wall 42. Immediately below the top wall 42 the side wall 38 is thickened to provide an internally threaded socket 44. A tapered pin 46, similar to the pin 32 of the ball 28, extends upwardly from the top wall 42. The two pins 46, 32 are flexibly connected by a short length of elastic tubing 48 made, for example, from rubber.

In FIG. 2 only the upper portion of the bag 16 is shown. The punching or striking bag itself consists of an inflatable resilient bag such as a thick walled toy helium balloon 52. A balloon of regular wall thickness may be used but a heavier wall usually provides better rebound action. The bag wall 54 is of course formed of an elastic material and when inflated defines an elastic envelope enclosing a chamber 56. The bag or balloon 52 has an inflation neck or orifice 58 with an edge or rim 60 which, in assembly, is stretched over an inflation collar 64.

The inflation collar 64 is similar in form to the top of a common bottle and consists of a frusto-conical skirt 66 having an outer surface 67 with a bottom or outer circular rim 68 surmounted by a generally cylindrical neck or body 70. The neck carries external threads 72 and is closed by a transverse wall 74 except for a central tapered through bore or passage 76. In assembly the passage 76 is closed by a tapered stopper 78, made of a resilient material such as rubber, and the bag 16 is connected to the suspension cap 36 by means of the mating screw threads at 72 and 44 respectively.

Figure 3:
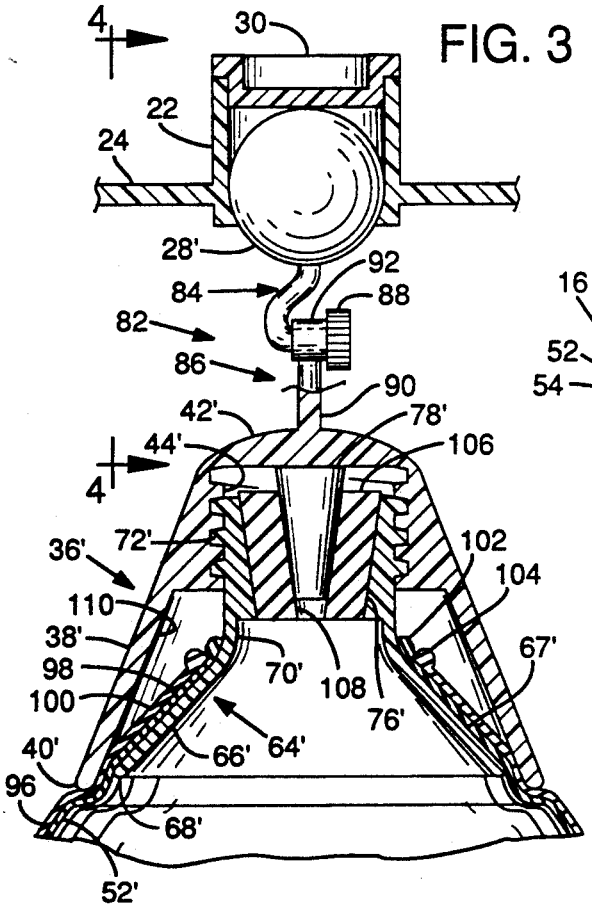
FIG. 3 is a view similar to FIG. 2 showing alternative embodiments of both the punching bag construction and its suspension.
Figure 4:
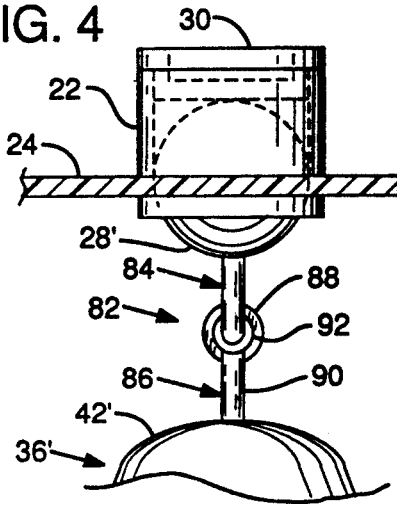
FIG. 4 is a partial view taken on line 4—4 of FIG. 3.

The general configuration of the second embodiment, as shown in FIG. 3, is very similar to that of the first embodiment of FIG. 2 but some apparently minor structural differences result in significant functional effects as will be described later. In the embodiment of FIG. 3 the short flexible element of the suspension (tube 48 in FIG. 2) has been replaced by a hinge 82 in which rigid upper and lower links 84, 86 respectively are pivotably connected together as shown in FIGS. 3 and 4. The somewhat hook shaped upper link 84 is rigidly connected to or is integral with the swivel ball 28' and is threaded at its free end to accept a knurled nut 88. Lower link 86 is rigidly connected to and extends upwardly from a bag suspension cap 36'. A pin portion 90, integral with cap 36', carries at its upper end a trunion 92 which closely fits the upper link 84 but is freely rockable on it. The hinge pivot is secured by the knurled nut 88.

The form of the bag suspension cap 36' is similar to that of suspension cap 36 of the first embodiment and includes a frusto-conical side wall 38' with a bottom rim 40', a partially domed top 42' from which extends the pin 90, and it has an internally threaded socket 44'. This second embodiment bag suspension cap 36' differs from the first embodiment primarily in having a relatively deeper side wall 38' and a larger diameter bottom or outer rim 40' so that the rim 40' extends outwardly and downwardly with respect to an inflation collar 64'.

The inflation collar 64' of the second embodiment (FIG. 3) is also very similar to that (64) of the first embodiment. It includes a frusto-conical skirt 66' with an outer surface 67' and a lower rim 68' surmounted by a cylindrical neck or body 70' carrying external threads 72'. But compared with the first embodiment, the neck (70') here is substantially open (similar to a relatively wide mouthed bottle) although the inside wall or bore 76' is tapered. A further variation of the second embodiment is in the use of a double walled inflatable resilient bag comprising, in this example, inner and outer balloons 52', 96 respectively. In assembly the inflation necks 98, 100 and their rims 102, 104, respectively are stretched over the skirt 66' of the inflation collar 64' and the bore 76' of the collar is closed by concentric stoppers 106 and 78'. Assembly is completed by mutual engagement of the threads 72' of the inflation collar 64' with those at 44' of the socket of the bag suspension cap 36'.

Looking now at the assembly and operation of the embodiment of FIG. 2 and beginning with the assembly of the punching bag 16—the balloon inflation neck or orifice 58 is stretched to allow the insertion of the skirt 66 of the inflation collar 64. The balloon is positioned approximately as shown in FIG. 2 with the rim 60 of the inflation neck concentrically surrounding the collar 64. The balloon wall 54 must overlap the skirt 66 sufficiently, and grip the collar tightly enough, to provide an airtight seal between the balloon wall and the collar. Gripping of the collar by the bag could of course be enhanced, or even largely effected, by auxiliary means such as a rubber band encircling the balloon inflation neck (not shown). Preferably the balloon is positioned so that the inflation neck rim 60 is adjacent the base of the neck 70 of the inflation collar. The balloon is inflated, for example, by mouth applied to the bore or orifice 76 and the inflation is maintained by inserting the plug or stopper 78.

Next the bag suspension cap 36 may be screwed onto the collar 64 by engaging their respective threads 44, 72 and tightened until the rim 40 of the cap firmly engages the wall 54 of the balloon and biases it against the skirt 66 of the collar. In the embodiment of FIG. 2 the respective rims 40, 68 of cap and collar are approximately equal in diameter, an efficient and effective arrangement for optimum control of the bag wall at a given nominal diameter. If desired, a washer may be used between the rim 40 of the cap and the balloon wall 54 to reduce friction when adjusting the cap 36 (not shown).

Completion of suspension of the punching bag 16 includes inserting the ball 28 in the socket 22 of the rebound board 12 and pressing the retaining cap 30 into the socket behind it. Final connection is made by inserting the pins 32 and 46 of the ball 28 and suspension cap 36 respectively into the resilient tube 48 as shown. The taper of the pins and the sizing of the pins and tube are such that the tube grips the pins sufficiently for normal use but releases on overload, as described more fully in U.S. Pat. No. 4,953,852 Donohue.

The assembly of the embodiment of FIG. 3 is in many respects similar to that of FIG. 2. However, here both inner and outer balloons 52' 96 respectively must be positioned on the collar 64' and manipulation of the balloons is facilitated by the relatively wide mouth offered by the tapered bore 76' of the inflation collar 64'. This opening is large enough to allow the insertion of a finger to assist in the positioning of the balloon inflation necks on the collar. Inflation is facilitated by first inserting the outer plug or stopper 106. The balloons then may be inflated through the central orifice 108 in the plug 106 and inflation then secured by insertion of a smaller plug or stopper 78'. As in the embodiment of FIG. 2, assembly of the punching bag is completed by screwing on the suspension cap 36' and tightening it until the walls of the double walled bag (balloons 52', 96) are firmly secured between the frusto-conical wall 38' of the cap and the skirt 66' of the collar. However, in this case, the rim 40' of the cap extends beyond the rim 68' of the collar so that clamping of the balloon walls occurs against the inside surface 110 of the cap side wall 38' rather than at its outer rim 40'.

In completion of the suspension of the embodiment of FIG. 3 the "short flexible element" is the hinge 82 rather than the resilient tube 48 of FIG. 2. The connection is made as shown in FIGS. 3 and 4 and secured by the knurled nut 88.

The functional and operational characteristics of both embodiments shown in the drawings are very similar. Together FIGS. 2 and 3 show alternatives in: suspension arrangements; juxtaposition of suspension cap rims or lips 40, 40' with inflation collar skirt rims 68, 68'; bag wall construction (single or double walled); and inflation valve configuration, 78, and 78' with 106. These individual structural variations have been combined somewhat arbitrarily into the two "embodiments" shown in FIGS. 2 and 3 for convenience in presentation. Particular combinations of these variations may have certain advantages but, in keeping with the invention, they may be used in any combination.

For convenience of description a certain assembly sequence has been suggested. But clearly other sequences may be used successfully.

An important feature of the invention is the adoption of an inflation collar (64, 64') as a medium for inflating and maintaining the inflation of the inflatable bag or bags of the punching bag. This provides the option (compared with the arrangement shown in '852 Donohue) of using a single or double walled inflatable envelope construction for the punching bag. '852 Donohue requires a balloon inside the collar and inflation and deflation requires manipulation and clamping or tying of the inflation neck of the inner balloon itself, with the possibility of early failure of the inflation neck. In the present invention, "valving" is provided by some more substantial structure such as that shown in the present embodiments. Of course any other suitable valve form, carried in the inflation collar 64, 64', may be used.

Maintenance of inflation depends not only on the security and fit of the valve components 78, 78' etc., but also on the seating of the inflation necks 58, 98, 100 on the collars 64, 64'. (Although, as mentioned above, auxiliary sealing means may be used.) Relative sizing must be appropriate and preferably the cone angle of the skirt 66, 66' is such that, upon initial inflation, the walls of the balloons 52, 52', 96 bear on the skirt even before the "bias" of the bag suspension cap 36, 36' is applied and, in fact the bag may perform quite successfully without the bias of a suspension cap rim. It is desirable (but not essential) that the skirt 66, 66' profile conforms approximately to that of the free form of the inflated balloon wall portion that overlays it. The skirt could, for example be curved in profile. But for optimum performance the balloon wall must at least bear on the skirt outer surface 67, 67' adjacent the skirt rim 68, 68', that is at the selected transfer or "pick-up diameter."

As shown in the drawings, components may be sized so that when the suspension cap 36, 36' is properly adjusted it not only biases the bag walls against the inflation collar skirt but may also brings its top wall 42, 42' to bear against the valve stopper 78, 78' and hold it in place.

Success of punching bag arrangements according to the invention in emulating the performance and characteristics of professional heavy-duty punching bags derives from the combination of a low friction articulated or compound suspension, including a universal swivel and a short flexible element, with a firmly resilient suspension attachment point or connection on the bag itself. Together the inflation collar 64, 64' and bag suspension cap 36, 36' so grasp the bag wall or walls, at a selected relatively large diameter annulus corresponding to the cap rim 40, 40', that cap and collar are substantially integrated with the balloon walls. The connection of suspension cap to bag is resilient but cap and collar become substantially integrated with the bag walls.

A collar 64, 64' with a relatively small skirt 66, 66' facilitates insertion into the balloon inflation neck. A relatively larger collar desirably transfers the effective connection point to the balloon walls to a larger diameter. This results in a firmer integration of the suspension with the bag and, in operation, produces a stronger "snap" or return against the platform In the arrangement of FIG. 3 the overlapping or extended rim 40' of the suspension cap places the effective pickup point for the walls at a greater diameter, beyond the rim 68' of the collar skirt. The skirt remains small enough for convenient assembly. Good results have been obtained when the diameter of the collar rim 68, 68' is approximately one-quarter of the diameter of the inflated balloon. For good rebound action it is important that at the effective "annulus" of attachment the balloon wall or walls be clamped or secured on both their inner and outer surfaces. For example, if in the arrangement of FIG. 3 the cap rim 40' extended substantially beyond the collar rim 68' then, in operation, under load in a certain direction, the balloon walls could pull away from the rim 40' so that the connection of the suspension to the bag was less positive.

Both suspension arrangements shown here enhance punching bag rebound action because they permit not only simple radial swinging of the punching bag (centered on the universal swivel, ball 28, 28') but also additional "hinging"—at the center of the flexible tube 48 in the embodiment of FIG. 2 or in hinge 82 of the embodiment of FIG. 3. However the embodiments differ in the action of their secondary "hinges". Flexible tube 48 provides a second universal swivel. Hinge 82 restricts swinging of the bag to a single plane (for a given position of the ball 28'). This pivoting restriction reduces the potential for an undesirable spin to develop upon striking the bag. Such spinning can disrupt the striking pattern or rhythm during a volley.

I claim:

1. A resilient bag for recreational use comprising:

a first elastic envelope having a wall and an inflation orifice in the wall and inflatable to define an enclosed chamber;

an inflation collar having a body with a through passage and a flange generally concentric with and extending outwards from the body, said flange having an outer surface and an outer rim; and valve means carried by the collar and associated with the through passage for controlling inflation of the envelope, wherein, in assembly, the inflation orifice of the envelope is stretched over the flange of the inflation collar and grips the collar with an airtight grip and the passage communicates with the chamber so that the bag may be inflated through the valve means and inflation maintained through the action of the airtight grip and the valve means and so that the wall of the envelope overlays the outer surface and bears on at least the rim of the flange and the collar is substantially integrated with the wall of the envelope.

2. The resilient bag of claim 1 and including a second elastic envelope encasing the first elastic envelope the envelopes being sized so that, upon inflation, the first expands and distends the second so that the respective walls of the envelopes substantially unite to define a single resilient envelope.

3. The resilient bag of claim 1 wherein the outer rim of the flange is circular and including means supported generally concentrically with respect to the inflation collar for engaging the envelope wall and biasing it towards the flange of the collar.

4. The resilient bag of claim 3 wherein the means for engaging and biasing has an outer rim generally concentric with the outer rim of the flange of the inflation collar and said respective rims are approximately equal in diameter.

5. The resilient bag of claim 3 wherein the means for engaging and biasing has an outer rim generally concentric with the outer rim of the flange of the inflation collar and said rim of the biasing means is of greater diameter than the outer rim of the flange.

6. The resilient bag of claim 3 wherein the means for engaging and biasing is adjustably connected to the body of the inflation collar.

7. The resilient bag of claim 1 wherein the valve means is removable whereby the through passage of the collar is openable to provide access through the passage to facilitate positioning of the elastic envelope on the collar.

8. The resilient bag of claim 1 wherein the valve means is defined by a removable stopper sized to fit tightly in the through passage of the body of the inflation collar.

9. A punching bag assembly comprising:

a first inflatable bag having a wall of a first elastic material and an opening in the wall;

suspension means including a collar and having an orifice and being disposed in the opening of the bag so as to be surrounded and gripped in an airtight grip by the bag; and valve means for association with the orifice of the collar for permitting inflation and deflation of the bag, the collar being arranged and configured so that, upon inflation, a portion of the bag wall surrounding the opening bears on the collar and the collar is substantially integrated with the wall of the bag.

10. The punching bag assembly of claim 9 and including a second inflatable bag having a wall of a second elastic material and an opening in the wall, said first and second materials having substantially similar material properties, the first bag being contained within the second bag with the openings in their respective walls in register, the bags being sized so that, upon inflation, the first bag expands and distends the second bag so that the walls of the bags substantially unite to define a single resilient envelope.

11. The punching bag assembly of claim 10 wherein the first and second bags comprise similar inflatable balloons.

12. The punching bag assembly of claim 9 wherein the suspension means includes an articulated connection comprising, in tandem, a universal swivel and a short flexible element.

13. The punching bag assembly of claim 12 wherein the universal swivel comprises a ball and socket.

14. The punching bag assembly of claim 12 wherein the flexible element is an elastic tube.

15. The punching bag assembly of claim 12 wherein the flexible element comprises a hinge including two elements pivotably connected together and including a first element rigidly connected to the universal swivel and a second element rigidly connected to the collar.

16. A method of making a punching bag comprising the steps of:

a) procuring a first inflatable elastic bag having a wall and an inflation neck defining an orifice;

b) inserting a stiff collar having a central aperture including a valve into the inflation neck of the inflatable elastic bag so that the orifice of the bag and the aperture of the collar are in register, and so that the inflation neck holds the collar in an airtight grip and the wall of the bag overlaps the collar with the collar inside the bag;

c) inflating the bag through the valve so that it distends and so that inflation pressure biases the wall of the bag against the collar;

d) suspending the punching bag by connecting the collar to a fixed support.

17. The method of claim 16 wherein the step of suspending the punching bag includes attaching a cap to the collar and the further step of adjusting the cap so as to create an additional biasing of the wall of the bag against the collar.

18. The method of claim 17 wherein the step of connecting to a fixed support includes connecting the cap to said support.

19. The method of claim 16 wherein the step of suspending the punching bag includes connecting a flexible element and a swivel in tandem between the collar and the fixed support.

20. The method of claim 16 including the additional step of procuring a second inflatable elastic bag similar to the first bag and encasing the first bag within the second before inflation of the first bag.

* * * * *